US005353441A

United States Patent [19]

Lazorchak

[11] Patent Number: 5,353,441

[45] Date of Patent: Oct. 11, 1994

[54] SOCK SUPPORT DEVICE

[76] Inventor: M. Denise Lazorchak, 35 Winterlane Cir., Essex Junction, Vt. 05452-3833

[21] Appl. No.: 120,057

[22] Filed: Sep. 13, 1993

[51] Int. Cl.[5] ..... A41F 11/16

[52] U.S. Cl. ..... 2/303; 2/240; 362/103; 24/342; 24/265 EC

[58] Field of Search ..... 2/303, 300, 338, 302, 2/306, 312, 240, 311; 450/111; 602/70; 362/103; 24/265 EC, 342

[56] References Cited

U.S. PATENT DOCUMENTS

| | | | |
|---|---|---|---|
| 701,998 | 6/1902 | Douglas | 24/342 |
| 1,772,274 | 8/1930 | Wolf | 2/303 |
| 1,781,673 | 11/1930 | Wolf | 2/303 |
| 3,173,147 | 3/1965 | Gross et al. | 2/452 |

*Primary Examiner*—Peter Nerbun
*Attorney, Agent, or Firm*—E. Michael Combs

[57] ABSTRACT

A support plate includes a support loop extending from an uppermost end of the support plate for securement relative to an individual garment, wherein a second end support plate has extending therefrom a keyhole slot arranged to receive a projecting boss and secure the projecting boss within a narrowed portion of the keyhole slot between an associated boss head integral with the projecting boss and a support web mounted to the projecting boss spaced from the head, with the sock captured within the keyhole slot by the projecting boss and boss head. For use in sporting events, a modification of the invention includes an illumination housing arranged for mounting to the keyhole slot for identification and delineation of various players relative to a sporting event such as hockey and the like.

3 Claims, 4 Drawing Sheets

FIG. 5
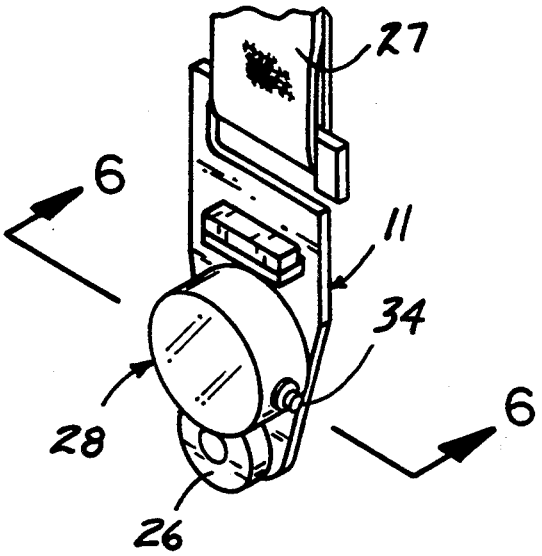
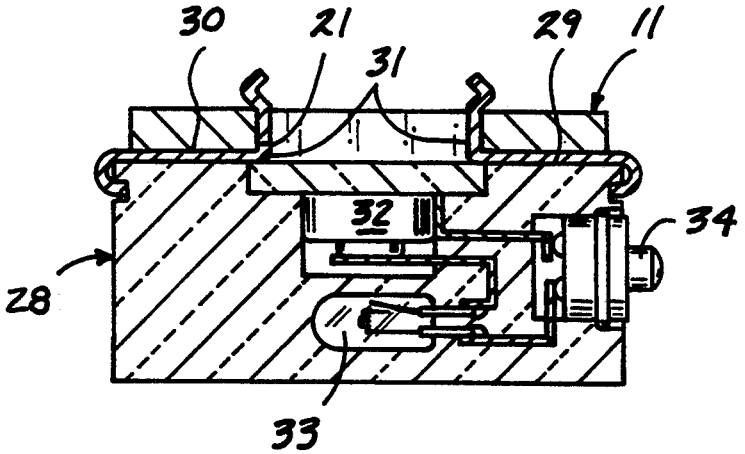
FIG. 6

FIG. 7
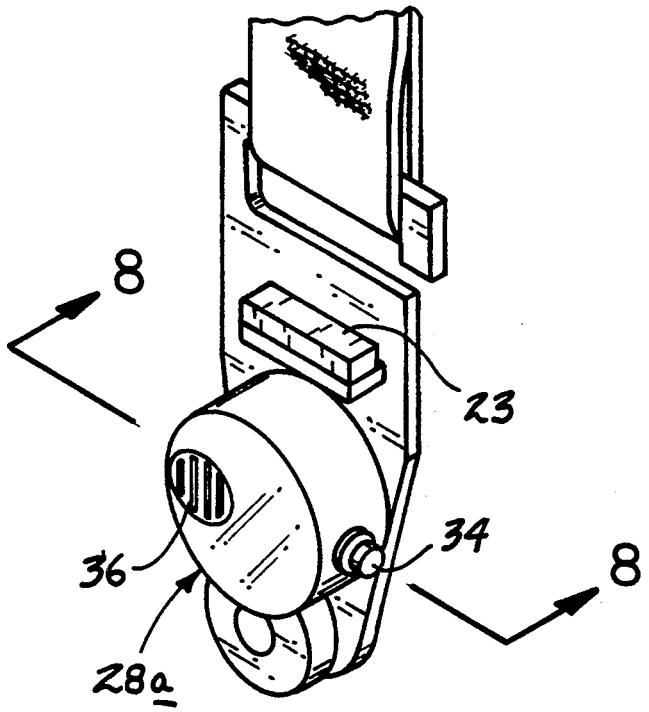
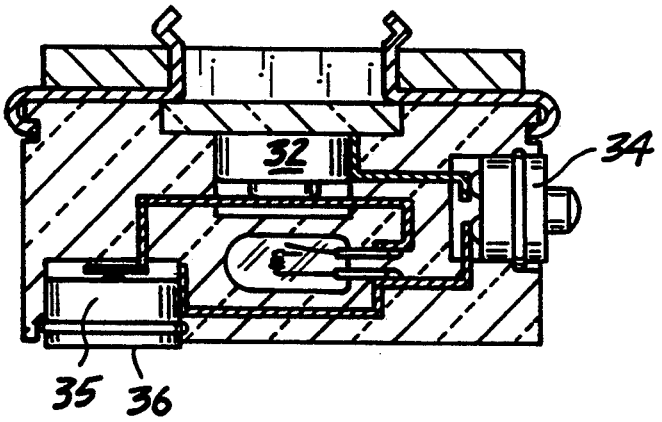
FIG. 8

SOCK SUPPORT DEVICE

BACKGROUND OF THE INVENTION

1. Field of the Invention

The field of invention relates to garment support structure, and more particularly pertains to a new and improved sock support device wherein the same is arranged to maintain socks in an extended orientation about an individual's lower limb portion.

2. Description of the Prior Art

Garment support structure is indicated in the prior art and exemplified by the U.S. Pat. Nos. 3,880,160 and 3,543,763 relative to supporting of sock structure.

The instant invention is addressed to a new and improved sock support device wherein the same is arranged for retrofit relative to existing garments and permits ease of securement and support of a sock relative to said garments and in this respect, the present invention substantially fulfills this need.

SUMMARY OF THE INVENTION

In view of the foregoing disadvantages inherent in the known types of sock support structure now present in the prior art, the present invention provides a sock support device including a plate member formed with a keyhole slot structure arranged to secure a sock relative to the keyhole slot. As such, the general purpose of the present invention, which will be described subsequently in greater detail, is to provide a new and improved sock support device which has all the advantages of the prior art sock support structure and none of the disadvantages.

To attain this, the present invention provides a support plate including a support loop extending from an uppermost end of the support plate for securement relative to an individual garment, wherein a second end support plate has extending therefrom a keyhole slot arranged to receive a projecting boss and secure the projecting boss within a narrowed portion of the keyhole slot between an associated boss head integral with the projecting boss and a support web mounted to the projecting boss spaced from the head, with the sock captured within the keyhole slot by the projecting boss and boss head. For use in sporting events, a modification of the invention includes an illumination housing arranged for mounting to the keyhole slot for identification and delineation of various players relative to a sporting event such as hockey and the like.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sock support device which has all the advantages of the prior art sock support structure and none of the disadvantages.

It is another object of the present invention to provide a new and improved sock support device which may be easily and efficiently manufactured and marketed.

It is a further object of the present invention to provide a new and improved sock support device which is of a durable and reliable construction.

An even further object of the present invention is to provide a new and improved sock support device which is susceptible of a low cost of manufacture with regard to both materials and labor, and which accordingly is then susceptible of low prices of sale to the consuming public, thereby making such sock support devices economically available to the buying public.

Still yet another object of the present invention is to provide a new and improved sock support device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an illustration of the invention further including illumination housing.

FIG. 6 is an orthographic view, taken along the lines 6—6 of FIG. 5 in the direction indicated by the arrows.

FIG. 7 is an isometric illustration of a modified illumination housing.

FIG. 8 is an orthographic view, taken along the lines 8—8 of FIG. 7 in the direction indicated by the arrows.

DESCRIPTION OF THE PREFERRED EMBODIMENT

Figure 1:
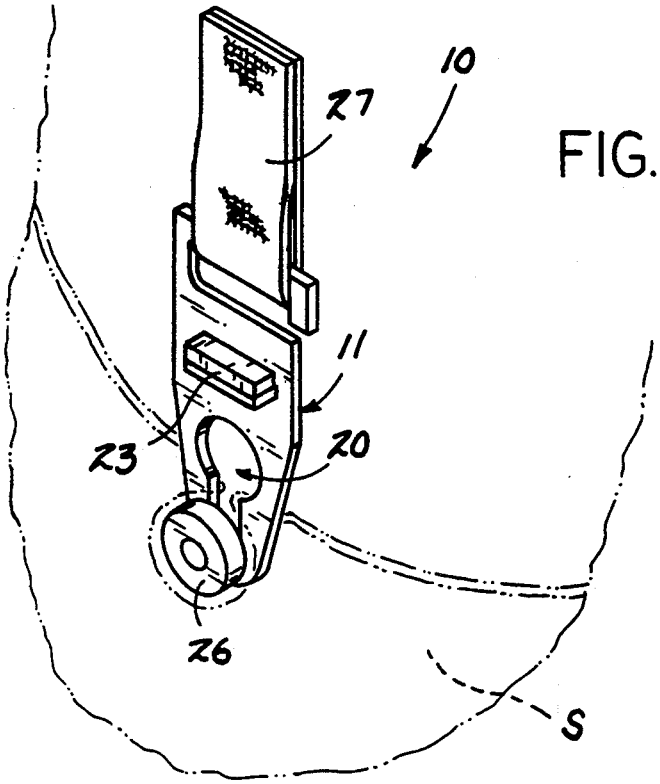
FIG. 1 is an isometric illustration of the invention.
Figure 2:
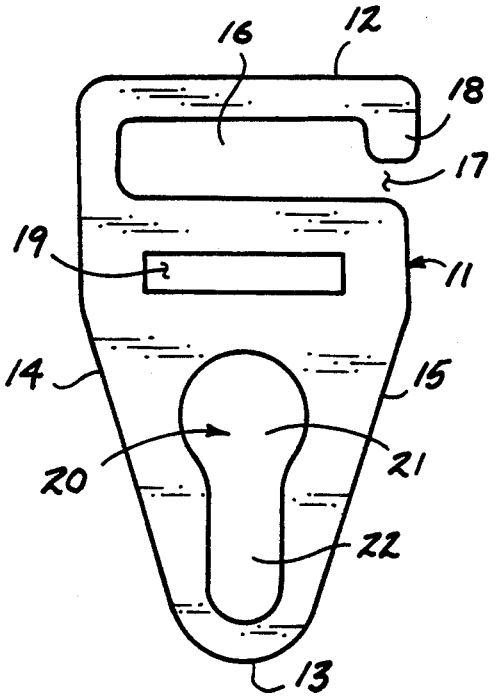
FIG. 2 is an orthographic view of the support plate.
Figure 3:
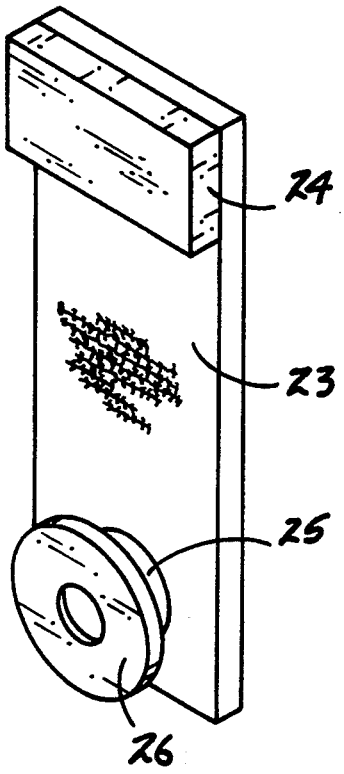
FIG. 3 is an isometric illustration of the support web.
Figure 4:
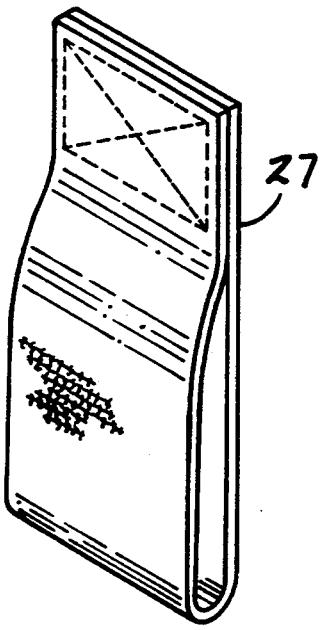
FIG. 4 is an isometric illustration of the associated support loop structure, as indicated in FIG. 1.

With reference now to the drawings, and in particular to FIGS. 1 to 8 thereof, a new and improved sock support device embodying the principles and concepts of the present invention and generally designated by the reference numeral 10 will be described.

More specifically, the sock support device 10 of the instant invention essentially comprises a support plate 11 having a first end 12 spaced from a second end 13, and a first side 14 spaced from a second side 15, as well as parallel front and rear walls. A support slot 16 is directed through the support plate 11 extending through the front and rear walls, and is in communication through the second side 15 through a slot entrance 17 by an abutment flange 18 extending along the second side 15. The support slot 16 is arranged to receive a support loop 27 of flexible construction permitting attachment of the support loop 27 to a garment or band (not shown) for securement about the individual's leg, wherein typically the support web 23 is provided as a means for suspending the support plate 11 during use. An intermediate slot 19 oriented parallel to the support slot 16 is directed through the support plate, with the intermediate slot 19 arranged to receive the anchor lug 24 of the support web 23 (see FIG. 3) that is suspended along the rear wall of the support plate 11, with the anchor lug 24 positioned at a first end of the support web 23, with the second end of the support web 23 having a projecting boss 25, with a projecting boss head 26 mounted to the projecting boss 25 at a coaxially aligned relationship, with the boss head 26 spaced from the support web 23. A keyhole slot 20 extends from the second end 13 of the support plate 11 orthogonally oriented relative to the intermediate slot 19. The keyhole slot includes an entrance opening 21 having a predetermined diameter in spaced adjacency relative to the intermediate slot, with an extension slot 22 in communication with the entrance opening 21, with the extension slot 22 having a slot width substantially greater than the predetermined diameter. To this end, the boss head 26 is formed with a head diameter arranged for reception through the predetermined diameter, with the head diameter greater than the slot width, with the projecting boss 25 arranged for sliding reception with the slot width such that mounting a sock "S" onto the boss head 26 and projecting the boss head as well as the sock through the entrance opening 21 permits securement of the sock by its securement between the boss head 26 and the support plate front wall about the projecting boss 25, in a manner as indicated in phantom in FIG. 1.

The FIG. 5 indicates the use of an illumination housing 28 formed of a transparent or at least translucent material. The use of the illumination housing 28 is arranged such as in sporting events to permit identification of a team leader, high scorers, or other distinguishing characteristics relative to individual players. The illumination housing 28 includes a housing rear wall 29 mounting a bracket plate 30 thereon, with the bracket plate 30 having spring-biased fingers 31 orthogonally oriented relative to the housing rear wall 29 projecting therefrom and spaced apart a spacing at least equal to said predetermined diameter for reception through said entrance opening 21. A battery 32 contained within the illumination housing is operative through a switch 34 projecting exteriorly of the illumination housing 28 and mounted thereon to effect illumination of an illumination bulb 33 encased within the illumination housing 28 to project illumination throughout the illumination housing for identification purposes. Additionally, a modified housing **28*a* may be provided, as indicated in the FIGS. 8 and 9, to further include an audio play member 35 employing available chip replace circuitry to direct such audible reproduction through a speaker 36 directed through the front wall of the housing 28*a* and operative simultaneously upon actuation and closing of the switch 34**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sock support device, comprising, a rigid support plate having a first end spaced from a second end, and a first side spaced from a second side, the support plate having a front wall spaced from a rear wall, with a support slot directed through the support plate extending through the front wall and the rear wall and extending through the second side spaced from and in adjacency to the first end, with the support slot spaced from the first side, a slot entrance directed through the second side into the support slot, and an abutment flange extending from the first end along the second side, with the abutment flange extending to the slot entrance, and a support loop received within the support slot between a support slot first side and the abutment flange, and a keyhole slot, the keyhole slot including an entrance opening having a predetermined diameter, with the entrance opening spaced between the first side and the second side, with an extension slot in communication with the entrance opening, having a slot width less than said predetermined diameter, the extension slot extending from the entrance opening to the second end in a spaced adjacency such that the extension slot is orthogonally oriented relative to the support slot, and a support web mounted to the support plate between the support slot and the entrance opening, with the support web having a projecting boss mounted to the support web, with the projecting boss having a boss width less than said slot width, and the projecting boss including a boss head integrally mounted to the projecting boss in a coaxially aligned relationship, with the boss head spaced from and extending parallel to the support plate front wall, with the boss head having a head diameter less than said predetermined diameter for reception through the entrance opening, and the support plate includes an intermediate slot between the support slot and the keyhole slot, with the support web having an anchor lug received through the intermediate slot.

2. A sock support device as set forth in claim 1 including a translucent illumination housing having a housing rear wall and a housing front wall, and a housing side wall, with the housing rear wall including a bracket plate, the bracket plate including spring-biased fingers orthogonally oriented relative to the housing rear wall, with the spring-biased fingers spaced apart for reception through the entrance opening, and the illumination housing including a battery contained therewithin and an illumination bulb, with a switch in electrical communication between the battery and the illumination bulb, with the illumination bulb encased within the illumination housing such that closing of the switch effects illumination of the illumination bulb within the illumination housing.

3. A sock support device as set forth in claim 2 including an audio play member mounted within the illumination housing extending through the housing front wall in operative communication with the switch for actuation of the audio play member upon closing of the switch.

* * * * *